United States Patent [19]

Kohn

[11] 4,262,717

[45] Apr. 21, 1981

[54] CONVERSION OF BALSA LOGS INTO PANELS

[75] Inventor: Jean Kohn, New York, N.Y.

[73] Assignee: Baltek Corporation, Northvale, N.J.

[21] Appl. No.: 77,617

[22] Filed: Sep. 21, 1979

Related U.S. Application Data

[63] Continuation-in-part of Ser. No. 50,699, Jun. 21, 1979.

[51] Int. Cl.[3] ..... B27D 1/00; B27F 7/00

[52] U.S. Cl. ..... 144/316; 144/317; 156/264

[58] Field of Search ..... 156/247, 264; 428/44, 428/48; 144/309 A, 309 D, 309 L, 309 P, 309 Q, 312, 314 R, 314 A, 315 R, 316, 317, 323, 326 R

[56] References Cited

U.S. PATENT DOCUMENTS

| | | | |
|---|---|---|---|
| 781,376 | 1/1905 | Sorensen | 144/316 X |
| 2,544,935 | 3/1951 | Orner | 144/316 |
| 3,977,449 | 8/1976 | Sadashige | 144/326 R |
| 4,111,247 | 9/1978 | Hasenwinkle | 144/316 |
| 4,122,878 | 10/1978 | Kohn | 144/316 |

FOREIGN PATENT DOCUMENTS

| | | | |
|---|---|---|---|
| 1453014 | 12/1968 | Fed. Rep. of Germany | 144/316 |

*Primary Examiner*—W. D. Bray

*Attorney, Agent, or Firm*—Michael Ebert

[57] ABSTRACT

A high-yield technique for converting logs of balsa having a small diameter into large rectangular panels. Each log is longitudinally cut into raw pieces, all of whose broad faces lie in a plane parallel to a tangent to the curvature of the log. The cuts are spaced to produce a pair of opposing side pieces having like thicknesses and at least one center piece. The uncut surfaces of the side pieces are faceted to provide stock pieces having a trapezoidal cross-section, whereas the uncut surfaces of the center piece are faceted to provide a stock piece having a rectangular cross-section. The stock pieces thus formed are fitted together in a complementary manner to create uniform layers thereof which are stacked to define a dry block. The pieces in the dry block are then wet-coated with a curable adhesive and reassembled to form a wet block which is subjected to compression until the adhesive is cured and the stock pieces interlaminated to form an integrated block. Finally, the integrated block is divided into panels of the desired thickness and grain direction.

11 Claims, 9 Drawing Figures

Fig. 1.
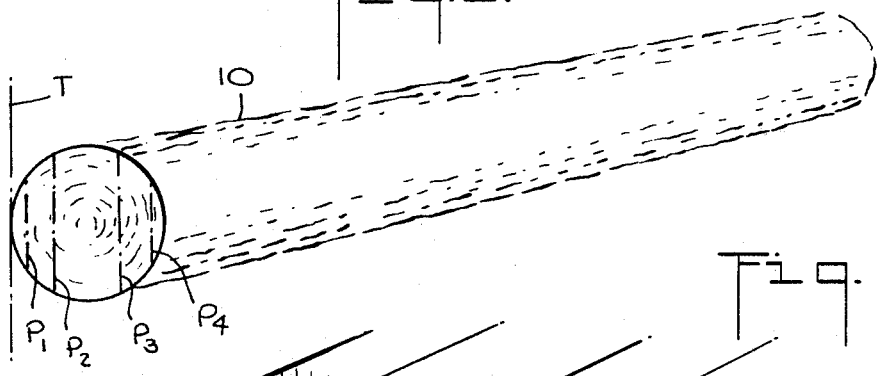
Fig. 2.
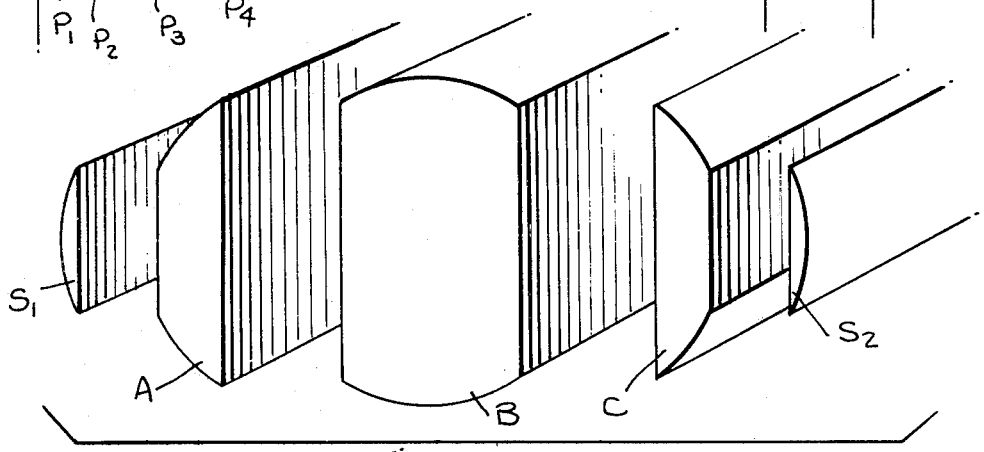
Fig. 3.
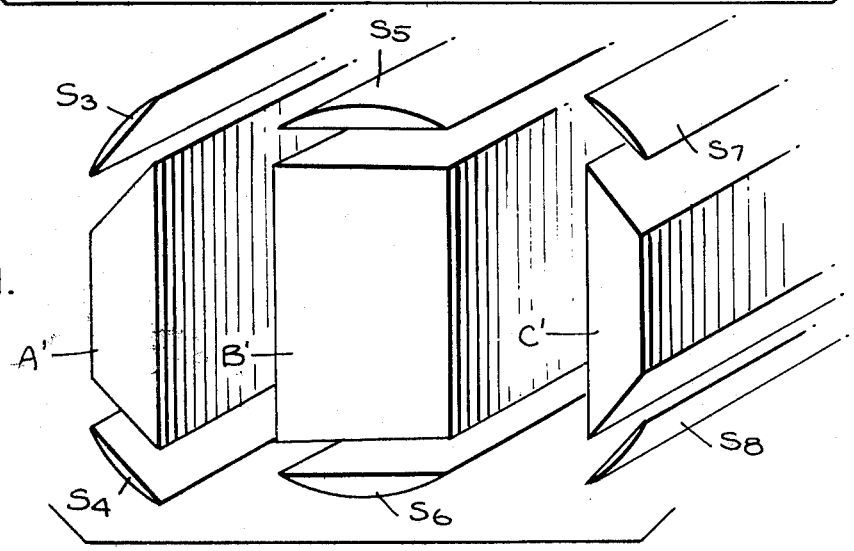
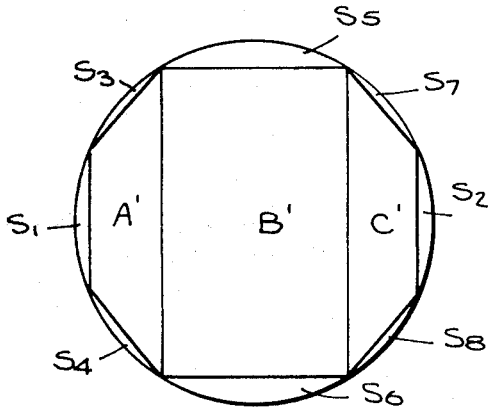
Fig. 4.

CONVERSION OF BALSA LOGS INTO PANELS

RELATED APPLICATION

This application is a continuation-in-part of my copending application Ser. No. 050,699, filed June 21, 1979, which relates back to an application Ser. No. 860,617, filed Dec. 14, 1977, entitled "Technique for Converting Balsa Logs into Panels," now U.S. Pat. No. 4,122,878.

BACKGROUND OF INVENTION

This invention relates generally to the conversion of round logs into lumber products by cutting the logs into pieces which are then joined together, and more particularly to a technique in which each log is cut and faceted to form a pair of side pieces having a trapezoidal cross section and at least one center piece having a rectangular cross section.

A technique in accordance with the invention, though applicable to various species of wood, is of particular value in connection with balsa wood derived from a tropical American tree (*Ochroma pyramidale*). Balsa wood has outstanding properties unique in the lumber field; for on the average, it weighs less than 9 pounds per cubic foot, this being 40% less than the lightest North American species. Its cell structure affords a combination of high rigidity and compressive and tensile strength superior to any composite or synthetic material of equal or higher density. While a technique in accordance with the invention will be described herein only in regard to balsa wood, it is to be understood that it is also applicable to other wood species.

The cost of balsa wood products has heretofore been keyed to the low yield obtainable when employing conventional techniques to convert balsa logs into usable products. The traditional conversion technique results in a low yield in that the amount of balsa convertible into usable lumber is usually less than half the total volume of wood in the log, the balance being wasted.

The economics of converting balsa logs into commercially-available lumber products must take into account a number of factors, such as growth time, kiln drying costs and the relationship of yield to tree diameter. The traditional conversion technique derives balsa lumber products from logs having a diameter of 12 inches or greater and inevitably results in products which are expensive. It not only requires about eight years before the trees can be harvested to produce logs of this size, but kiln costs are high and the yield is low, in that a large percentage of the wood is wasted in the conversion process.

A marked improvement in the economics of converting balsa logs into usable products is gained by the technique disclosed in my prior U.S. Pat. No. 4,122,878, entitled "Technique for Converting Balsa Logs into Panels," the entire disclosure of which is incorporated herein by reference. In this patented technique, logs are radially cut into sectors having the same apex angle, each sector then being longitudinally sliced at its apex and arc to form a truncated piece having a trapezoidal cross-section, only a relatively small percentage of the wood being wasted. The pieces are thereafter fitted together in a complementary manner and interlaminated to form an integrated stock block which is dividable into panels.

The technique disclosed in my prior patent makes it possible to commercially exploit a broad range of balsa log diameters, running from small diameter logs cut from trees which take only 9 to 10 months to grow, to large diameter logs cut from more mature trees that take at least 5 to 8 years to grow. In this way, better use can be made of the available acreage. And because the logs are cut radially, the resultant area of the exposed surfaces is greater than that obtained with conventionally cut logs, thereby markedly reducing kiln drying time and its attendant costs. But even more important is the fact that the yield is exceptionally high; for, as compared to a traditional conversion which requires 60 logs of 12-inch diameter and 16 feet length to produce 1,000 board feet of balse product, the technique disclosed in my prior patent yields the same amount of product from merely 20 such logs.

The technique disclosed in my prior patent attains its greatest efficiency both with respect to yield and labor costs when used in conjunction with logs whose diameter exceeds 10 inches. In terms of labor costs, the efficiency factor drops off for logs of smaller diameter; for then the trapezoidal pieces are relatively small and require, per 1,000 board feet of finished integrated blocks, much more handling than pieces derived from logs of larger diameter.

For example, assuming an integrated block whose dimensions are two feet by four feet by six feet, if the pieces from which the block is formed are sector-cut pieces taken from logs having diameters in the range of 6 to 8 inches, the number of pieces necessary to complete this block is far greater than the number required when the pieces are sector-cut from logs having diameters of 10 to 12 inches. Whether the log is of small or large diameter, eight sectors are cut therefrom, but the total volume of eight sectors taken from a small diameter log is much below that of sectors from a large diameter log. Since each piece has to be separately handled and individually wet-coated when assembling the pieces into a block, much more handling is involved all along the production line when using smaller pieces.

On the other hand, as noted in my prior patent, since young balsa trees of small diameter (10 inches or less) are more readily available than older trees of larger diameter, there are distinct economic advantages in converting trees of small diameter into usable lumber. In planting balsa trees, if one harvests trees while their diameters are small, this makes possible a rapid turnover in the order of 4 to 6 years, whereas for trees which are not harvested until they are 11 to 12 inches in diameter, the growth period is 6 to 8 years. However, with the technique disclosed in my prior patent, the increased handling requirements entailed when using small diameter trees and the resultant increase in production costs tend to offset the economic advantages gained by exploiting such trees.

SUMMARY OF INVENTION

In view of the foregoing, the main object of this invention is to provide a high yield technique for efficiently converting balsa logs of relatively small diameter into large rectangular panels.

A significant feature of the present invention, as compared to the technique disclosed in my prior patent in which logs 10 inches in diameter or smaller are sector-cut into eight pieces, is that in the present technique only three or four pieces are cut from the log, thereby substantially reducing the handling requirements in forming an integrated block from these pieces. And because fewer pieces are required to create the block, the quantity of adhesive necessary for interlaminating the pieces is reduced.

Also an object of the invention is to provide a technique in which derived from logs are stock pieces having a trapezoidal cross section as well as stock pieces having a rectangular cross section, all of which pieces may be used to create an integrated block. Alternatively, the stock pieces having a rectangular cross section can be used as traditional lumber, particularly since, as contrasted to pieces which are sector cut from a log and have a width equal to the radius thereof, these stock pieces have a width almost equal to the diameter of the log.

Briefly stated, in a technique in accordance with the invention each log of small diameter (10 inches or less) is cut longitudinally into raw pieces whose broad faces all lie in a plane parallel to a tangent to the curvature of the log. These cuts are spaced to produce opposing side pieces having like thicknesses and at least one center piece.

After the raw pieces are kiln dried, the uncut surfaces of the side pieces are faceted to provide stock pieces having a trapezoidal cross section, whereas the uncut surfaces of the center pieces are faceted to provide a stock piece having a rectangular cross section. Thus the only waste lies in the thin chordal slabs removed from the pieces.

The stock pieces are then fitted together in a complementary manner to create uniform layers thereof which are stacked to define a dry block. The pieces in the dry block are then wet-coated with a curable adhesive and reassembled to form a wet block which is subjected to compression until the adhesive is cured and the stock pieces interlaminated to form an integrated block. Finally, the integrated block is divided into panels of the desired thickness and grain direction.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a typical balsa log which is cut into raw pieces in the manner of the present invention;

FIG. 2 illustrates the separated raw pieces;

FIG. 3 shows stock pieces obtained by faceting the raw pieces;

FIG. 4 is a transverse section of the log which is divided in accordance with the invention to show which region thereof is usable as stock pieces and which portion represents waste;

DESCRIPTION OF INVENTION

Referring now to FIG. 1, there is shown a round log 10 of balsa wood, the log having a diameter of about 10 inches or less depending on the age of the tree from which it was cut. The log is naturally formed with concentric annular rings and rays.

Log 10 is longitudinally cut in planes $P_1$, $P_2$, $P_3$ and $P_4$ which will lie parallel to a tangent T to the curvature of the log. The spacing of these cuts is such as to produce, as shown in FIG. 2, a thin chordal slab $S_1$, a raw side piece A, a raw center piece B, a raw sidepiece C, whose thickness is the same as piece A, and a thin chordal slab $S_2$, the slabs being waste material.

The raw pieces A, B and C, which are all of the same length, are then kiln dried in a conventional oven of the type used for lumber drying to reduce the moisture content thereof to 12 percent or less, this being standard practice in the lumber industry.

The kiln-dried pieces A, B and C are then milled to facet the uncut surfaces thereof to produce stock pieces A′, B′ and C′. Thus removed from piece A′ are thin slabs $S_3$ and $S_4$, from piece B′ slabs $S_5$ and $S_6$, and from piece C′ slabs $S_7$ and $S_8$. In the case of side pieces A′ and C′, the milling is at an acute angle with respect to the plane of the faces, so that these pieces have an isosceles trapezoidal cross section with base angles of, say, 50°. In the case of center piece B′, the milling is at a right angle with respect to the plane of the faces to produce a stock piece having a rectangular cross section.

Since the stock pieces A′, B′ and C′ derived from log 10 represent the usable lumber, the fact that most of the log is usable is made evident in FIG. 3, where it will be seen that pieces A′, B′ and C′ together have an octagonal cross section, the thin chordal slabs $S_1$ to $S_8$ at the boundaries of the octagon representing waste. In a conventional wood utilization technique, a square region is cut from the round log with a far greater loss of wood.

In practice, the center piece B′ may be a single piece, as shown, or further divided, depending on the original diameter of the log from which it is derived. For example, if the log has a 6-inch diameter, then the side pieces can be cut with a uniform thickness of $1\frac{1}{2}$ inches each, and the center piece with a uniform thickness of 2 inches, waste slabs $S_1$ and $S_2$ having a maximum thickness of $\frac{1}{2}$ inch. But if the log has a 10-inch diameter, then the side pieces may both have a uniform thickness of 2 inches with two center pieces of $2\frac{1}{2}$ inches each, and waste slabs each of $\frac{1}{2}$ inch.

Figure 5:
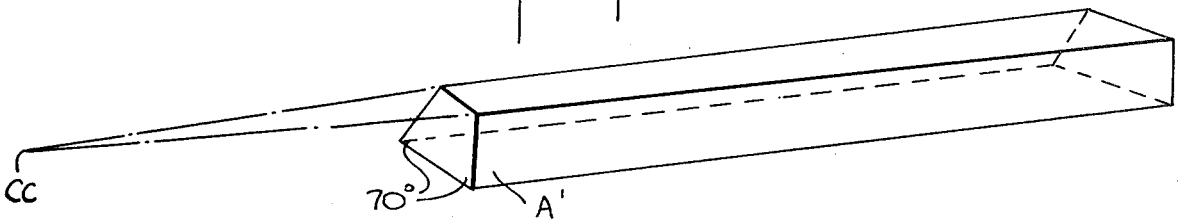
FIG. 5 illustrates in perspective a single stock piece having a trapezoidal cross-section.

Geometrically, each of the stock pieces having a trapezoidal cross-section, such as piece A′, has the formation shown in FIG. 5 in which the piece has base angles of 70°. It is important to note that the piece has a wedge-like formation, in that the log from which it is taken has the shape of a truncated cone, since the tree naturally has a gradual taper. Thus in geometric terms, imaginary lines projecting from the longitudinal edges of the piece converge toward a common center CC. Hence by juxtaposing adjacent pieces in reverse relation, the taper is sufficiently cancelled out.

Figure 6:
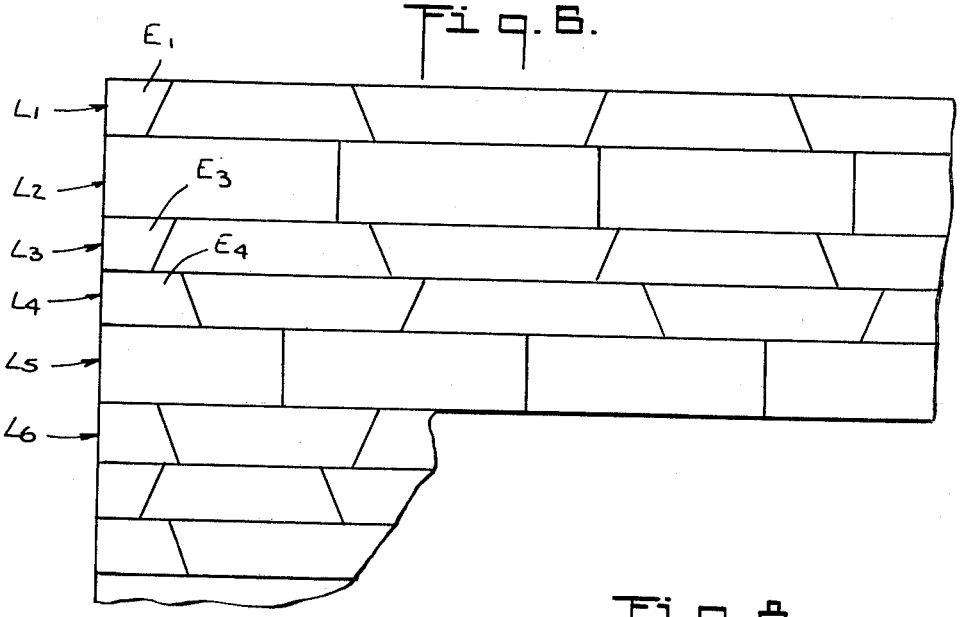
FIG. 6 illustrates a multiple-layer stack of stock pieces.

The next step is to set up stock pieces of the same height in side-by-side and reversely-oriented relation with their sides complementing each other to form an even layer, which, for example, may be 24 inches wide. In FIG. 6, there is shown a stack of layers $L_1$, $L_2$, $L_3$, $L_4$, etc. Each layer is composed of pieces of the same thickness so that the height of the layer is uniform throughout. Layer $L_1$ is composed of stock pieces having a trapezoidal cross section, this being true also of layers $L_3$ and $L_4$, whereas layers $L_2$ and $L_5$ are formed of stock pieces having a rectangular cross section. Whether a given layer is composed of trapezoidal or rectangular cross-sectional pieces is immaterial as long as all pieces in the layer are of the same thickness.

Figure 7:
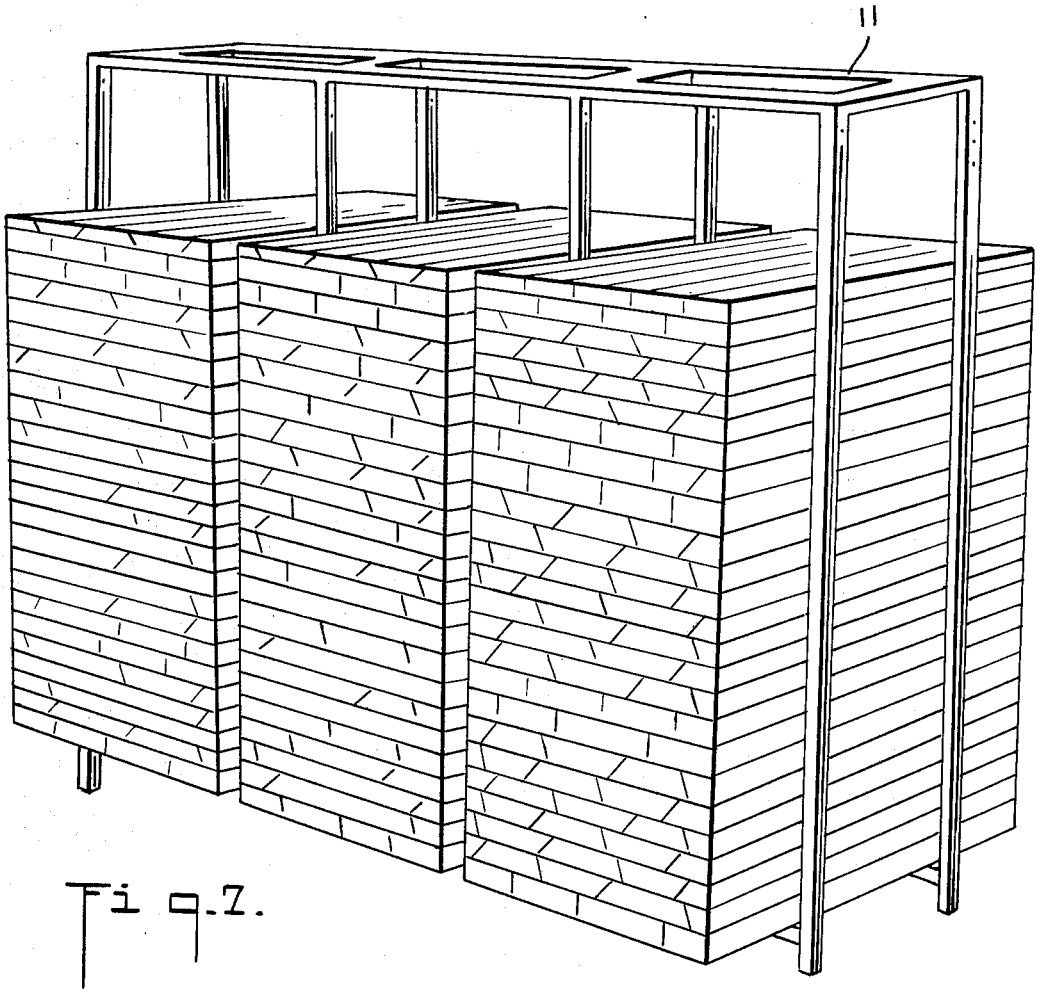
FIG. 7 shows the frame for holding a dry block of stock pieces.

The superposed layers which form a stack are assembled, as shown in FIG. 7, within a frame 11, each stack constituting a dry block of stock pieces, two feet long. In practice, this block may be two feet wide and four feet tall or whatever other practical dimensions are dictated by the available equipment.

In order to provide lateral faces or block edges which are vertical, the ends of those layers ($L_1$, $L_3$, $L_4$ etc.) which are made of up trapezoidal stock pieces are terminated by piece halves, such as end pieces $E_1$, $E_3$ and $E_4$. It will be evident that when a feedstock piece having an isosceles trapezoidal cross-section is cut in half to produce two end pieces, each end piece has a slanted side and a vertical side. The slanted side of an end piece complements the slanted side of the adjacent feedstock piece in the layer, the vertical side forming the edge of the block assembly.

The several pieces which form a given layer may have somewhat different widths, but they all have exactly the same thickness. However, while the layers are all uniform in length and width, they differ in thickness; for in extracting pieces from logs of large diameter to obtain the maximum yield therefrom, the resultant pieces are necessarily thicker than those extracted from logs of smaller diameters; consequently, the overall pattern of pieces in the blocks is more or less random, so that when the pieces are glued together, the glue lines of the various pieces are not in registration with each other, and the resultant reticulated formation of glue lines in combination with blocks of random widths acts to strengthen the block structure.

Figure 8:
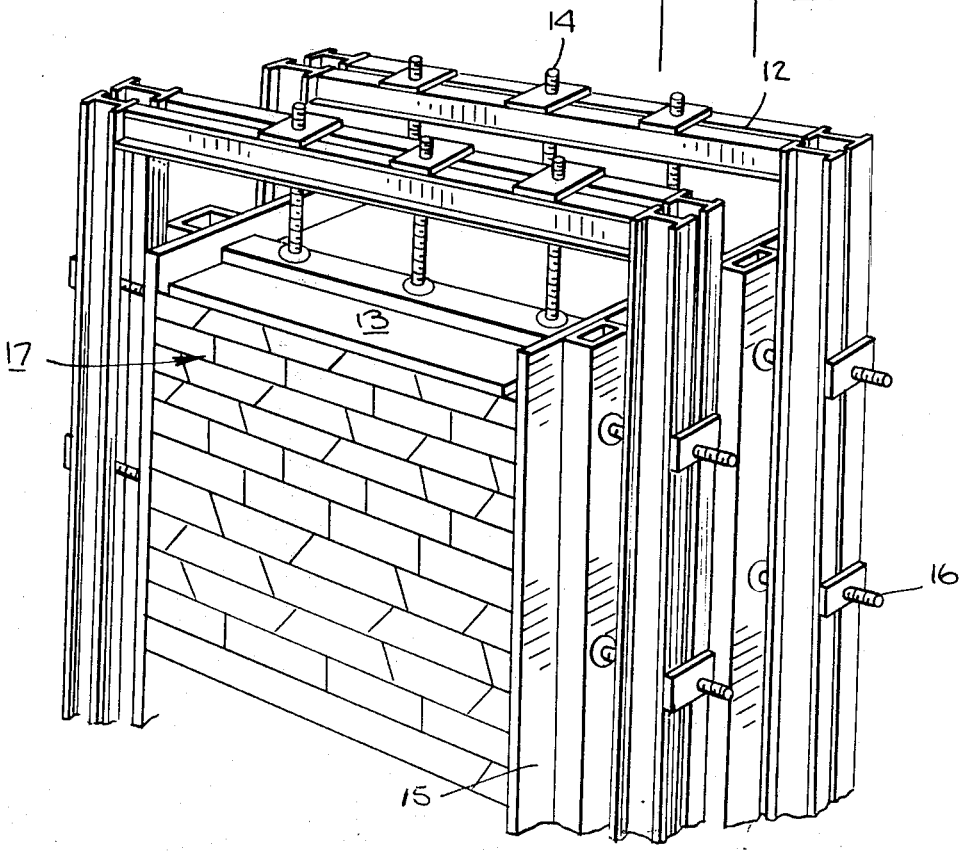
FIG. 8 illustrates the press for interlaminating the stock pieces of a wet block to form an integrated block.

To form an integrated block, the pieces of the dry block assembly are taken from frame 11 and wet-coated with a suitable water-resistant adhesive resin such as urea formaldehyde or phenol resorcinol formaldehyde, the wet pieces being reassembled in a cold setting press, as shown in FIG. 8. The press is provided with an I-beam frame 12 which is large enough to accommodate the block assembly, an adjustable horizontal pressure plate 13 operated by vertical screws 14 and an adjustable vertical pressure plate 15 operated by horizontal screws 16, pressure plate 13 being movable toward or away from the top surface of the block assembly and pressure plate 15 being movable toward or away one side surface of the block assembly. The bottom surface of the block assembly rests on a base plate in the press and the other side surfaces of the block assembly abuts a fixed side plate.

By turning in the vertical and horizontal screws to press the pressure plates against the wet block assembly, the assembly in the press is subjected to compression in orthogonal directions. This condition is maintained until such time as the adhesive is fully cured and the pieces laminated together to form an integrated stock block 17.

Figure 9:
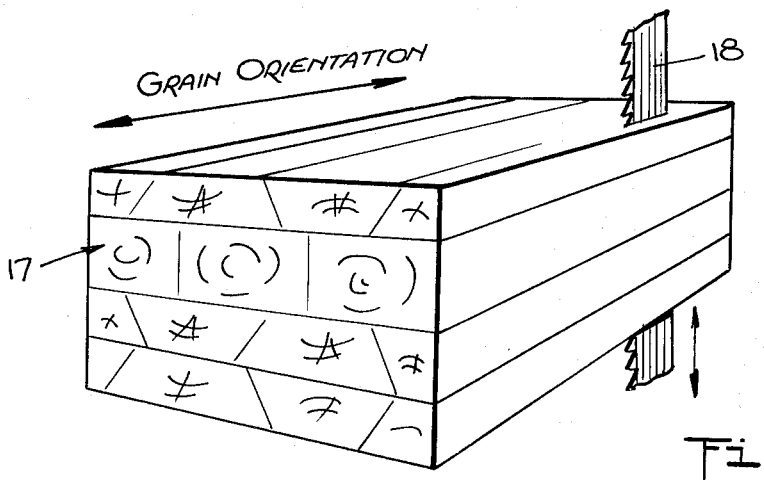
FIG. 9 shows the integrated block being divided into panels.

The integrated stock block 17, as shown in FIG. 9, is then removed from the press. The grain direction of the stock block extends longitudinally, for all pieces thereof have the same orientation. This stock block can now be divided to provide either flat grain or end grain balsa panels of the desired thickness. A flat grain panel is one in which the balsa fibers run parallel to the faces of the panel. To produce flat grain panels, the stock block is sliced into panels by a wide band saw 18 operating in the longitudinal direction of the block.

An end grain panel is one in which the balsa fibers are perpendicular to the faces. The same stock block may be divided to provide end grain panels. In this instance, saw 18 is operated in the transverse direction of the block.

The end grain or flat grain panels thus produced are then planed or sanded, as the case may be, to obtain either a better finish or a more precise thickness. Flat grain panels can be sanded or planed, whereas end grain panels can only be sanded. The panels are then trimmed to the width and length specified by the ultimate user.

While there has been shown and described a preferred embodiment of conversion of balsa logs into panels in accordance with the present invention, it will be appreciated that many changes and modifications may be made therein without, however, departing from the essential spirit thereof.

I claim:

1. A high-yield technique for converting logs of small diameter into large rectangular panels, said technique comprising the steps of:

A. longitudinally cutting each log into raw pieces, all of whose broad faces lie in a plane parallel to a tangent to the curvature of the log, the cuts being spaced to produce a pair of opposing side pieces having like thicknesses and at least one center piece;

B. faceting the uncut surfaces of the side pieces to provide stock pieces having a trapezoidal cross section;

C. faceting the uncut surfaces of the center piece to produce a stock piece having a rectangular cross section;

D. fitting together said stock pieces in a complementary manner to form a stack of layers each of which has a substantially uniform thickness, thereby creating a dry block;

E. wet-coating the stock pieces in the dry block with a curable adhesive and reassembling the wet pieces to form a wet block;

F. subjecting the wet block to compression for a period sufficient to cure the adhesive and to interlaminate the stock pieces thereof to produce an integrated block; and G. dividing the integrated block into panels.

2. A technique as set forth in claim 1, wherein some of the layers are composed of stock pieces having a rectangular cross-section and others by stock pieces having a trapezoidal cross section.

3. A technique as set forth in claim 2, wherein the layers of trapezoidal stock pieces are provided with end pieces constituted by stock piece halves to present vertical block edges.

4. A technique as set forth in claim 1, wherein the stock pieces are derived from tapered logs and therefore have a wedge-like formation; the comlementary pieces being reversely-oriented to effectively cancel out the taper.

5. A technique as set forth in claim 1, wherein said logs are of balsa wood.

6. A technique as set forth in claim 5, wherein said raw pieces are kiln-dried before being faceted into stock pieces.

7. A technique as set forth in claim 6, wherein said raw pieces are dried to a moisture content of about 12 percent.

8. A technique as set forth in claim 1, wherein said curable adhesive is a water-resistant synthetic adhesive.

9. A technique as set forth in claim 8, wherein said adhesive is urea formaldehyde.

10. A technique as set forth in claim 1, wherein said integrated block is divided in a direction producing end grain balsa panels.

11. A technique as set forth in claim 1, wherein said integrated block is divided in a direction producing flat grain balsa panels.

* * * * *

UNITED STATES PATENT OFFICE

CERTIFICATE OF CORRECTION

Patent No. 4,262,717 Dated April 21, 1981

Inventor(s) Jean Kohn

It is certified that error appears in the above-identified patent and that said Letters Patent are hereby corrected as shown below:

Claim 4, line 3, "comlementary" should read -- complementary --

Signed and Sealed this

*Twenty-second* Day of *September 1981*

[SEAL]

*Attest:*

GERALD J. MOSSINGHOFF

*Attesting Officer* *Commissioner of Patents and Trademarks*